United States Patent [19]

Borca et al.

[11] 4,371,288

[45] Feb. 1, 1983

[54] FLUID IMPERMEABLE LINER FOR A CAVITY IN THE EARTH

[75] Inventors: Bruno Borca; Emilio Ruscelli, both of Milan, Italy

[73] Assignee: Industrie Pirelli S.p.A., Milan, Italy

[21] Appl. No.: 131,823

[22] Filed: Mar. 19, 1980

[30] Foreign Application Priority Data

Mar. 27, 1979 [IT] Italy ..... 21304 A/79

[51] Int. Cl.[3] ..... B65G 5/00

[52] U.S. Cl. ..... 405/53; 220/403; 405/150

[58] Field of Search ..... 405/53, 150, 288; 24/243 B, 243 K; 52/63, 203, 222, 273; 135/15 CF; 138/108, 137, 147; 220/18, 403

[56] References Cited

U.S. PATENT DOCUMENTS

| | | | |
|---|---|---|---|
| 2,797,696 | 7/1957 | Fritsche | 135/15 CF |
| 3,400,849 | 9/1968 | Pottier et al. | 220/18 X |
| 4,239,416 | 12/1980 | Borca et al. | 405/53 |

FOREIGN PATENT DOCUMENTS

| | | | |
|---|---|---|---|
| 576924 | 6/1959 | Canada | 405/53 |
| 1238946 | 4/1967 | Fed. Rep. of Germany | 405/150 |
| 2607604 | 9/1977 | Fed. Rep. of Germany | 405/150 |
| 593416 | 11/1977 | Switzerland | 405/150 |
| 401805 | 2/1974 | U.S.S.R. | 405/53 |

*Primary Examiner*—David H. Corbin

*Attorney, Agent, or Firm*—Stevens, Davis, Miller & Mosher

[57] ABSTRACT

A liner adapted to be installed against an earth surface bordering a cavity such as a cave or a hole in the ground to prevent flow of fluid into and from the surrounding earth. The liner is a flexible, inextensible, fluid impervious material which is a wall of a closed hollow member adapted to be inflated after installation in the cavity to expand it with a fluid under pressure until its wall presses against the earth wall about the cavity. A non-woven fabric layer between the earth and flexible inextensible wall facilitates sliding of the wall over the earth surface. The clamps have spaced elongated cylindrical members such as tubes disposed along the cavity wall and secured to the earth wall with base members having one end embedded in the earth and an opposite end fixed to the tube. An arcuate shaped clamping member is associated with the tube to form a jaw for clamping the liner between the tube and arcuate shaped member.

8 Claims, 7 Drawing Figures

FIG.5
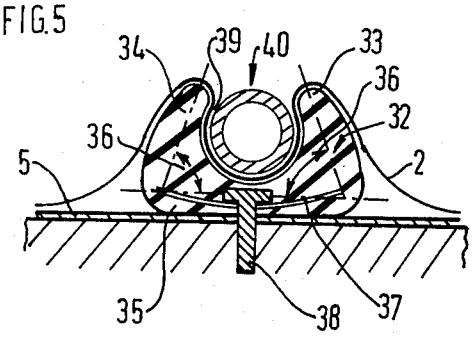
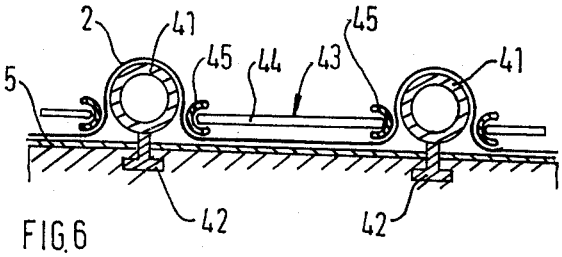
FIG.6
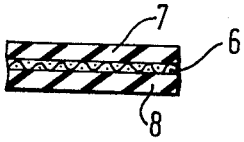
FIG.7

FLUID IMPERMEABLE LINER FOR A CAVITY IN THE EARTH

This invention relates to a fluid impermeable covering for cavities in the earth for storing a fluid.

It is known to line cavities in the earth with a fluid impermeable sheathing and particularly for lining caves. These known coverings are sheets of a flexible and fluid impermeable material which are sealed one to the other, in such a way as to line the inner walls of the cavern and adapt it for containing a fluid.

However, these known fluid impermeable sheathings have various drawbacks.

One of these drawbacks is that the lining collapses when the cave is emptied of fluids. Such a collapse often impedes any further utility of the cavity as a container.

Another disadvantage is that it is difficult to avoid complete bonding of the sheathing to the cave surface and in this way, avoiding ruptures in the sheathing if there are fissures in the wall of the cavity.

One known solution for these disadvantages is to support the sheathing on a frame.

This solves the stated disadvantages, but other disadvantages are introduced including:

(1) reduction in the cave's capacity, due to the presence of the frame;

(2) an unsatisfactory service-life of the supporting frame, because of corrosion taking place when the frame comes into contact with the fluid that is enclosed in the cave or other cavity serving as a container which requires periodic unkeep and servicing of the frame;

(3) the possibility of contamination of the fluid;

(4) the difficulty in mounting the supporting structure for the sheathing; and (5) the high cost involved for lining a cave or other cavity.

An object of the present invention is to provide a fluid impermeable covering for lining cavities in the ground, in general, and in particular for containers or the like to be used for containing fluids and which do not manifest any of the known drawbacks for linings, and are easily installed, which have a long service-life; which prove to be safe against any contamination of the fluid contained therein; and which involves a very low cost.

A more specific object of the invention is to provide an improved method for lining a cavity or hole in the earth with a fluid impermeable sheet to be used as a container of a fluid. Still another object of the invention is to provide an improved lining for a cavern in the earth which adapts the cavern for storing a fluid.

Other objects will become apparent from the following description with reference to the accompanying drawing wherein FIG. 1 is a perspective view of a tract of a cave that is provided with a lining according to the present invention;

FIG. 5 shows a cross-section of an additional alternative embodiment of a clamp for attaching an envelope to the cave wall;

FIG. 6 shows a cross-section of an alternative embodiment of a clamp for attaching an envelope to the cave wall; and FIG. 7 shows a cross section of the lining envelope provided by the invention.

The foregoing objects and others are accomplished in accordance with this invention generally speaking, by providing a closed envelope of fluid impermeable, flexible and inextensible sheet material for lining a cavity such as a cave and a plurality of clamps firmly fixed to the wall of the cavity for fastening the sheet to the wall of the cavity along a line or tract without interrupting the continuity of the sheet.

More particularly, the clamps are at least one pair of shaped structural elements or lengths of said shaped structural elements, united one with the other, and with the interposition of the sheet constituting the envelope, where one shaped structural element of the pair is fixed down at least along a stretch or at least along a length of a line of the container or cave wall, and the second shaped structural element of the pair, locks, acting like a jaw, upon the first element, blocking the envelope over the latter.

Figure 1:
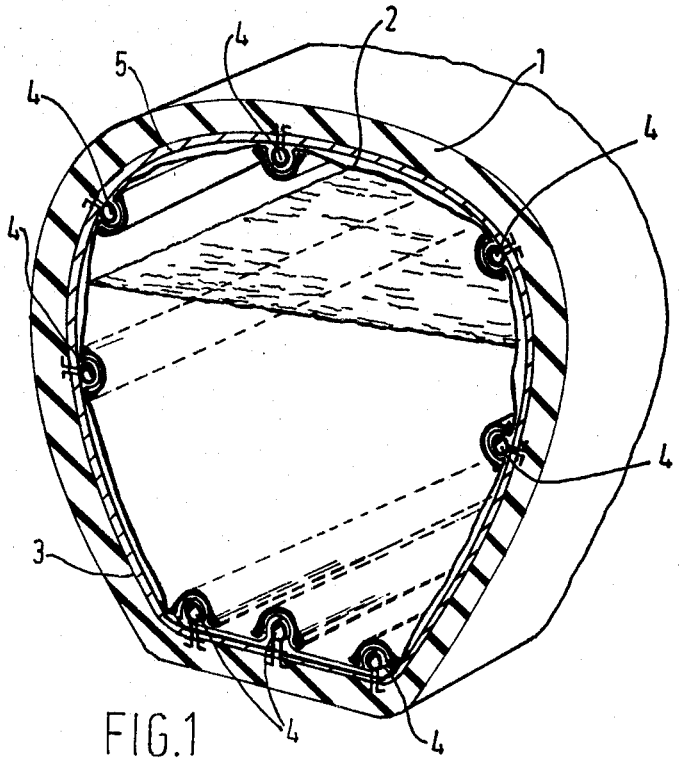

One embodiment, for the impermeabilizing lining for cavities to be used as fluid containers or tanks is illustrated in FIG. 1.

As shown in FIG. 1, the inner cavity of the container or cavern 1, there is housed a closed envelope 2 formed by a single sheet, or by several sheets that are firmly sealed one to the other. The sheet is an impermeable, flexible and inextensible material, the structure of which shall be described in more detail later on.

The envelope 2, is connected to the surface of the cavity 3 of the container or cave 1, by clamps 4, according to the detailed description given further on herein, that brings about a connection, along line-tracts, between the envelope 2 and the surface of cavity 3, and along which the connection may be either continuous or dis-continuous.

Moreover, between the cave surface and envelope 2, there is also attached a sheet of non-woven fabric 5 to the cave surface.

As stated previously, the closed envelope housed in the container, is formed by a sheet of impermeable, flexible and inextensible material, and the particular structure of the sheet is illustrated in FIG. 7.

As shown in FIG. 7, the sheet forming the envelope 2, is a rubberized fabric, i.e. fabric 6, disposed between two elastomeric layers 7 and 8.

The elastomeric material is of a conventional composition made to resist the actions of the fluid enclosed in the container, the non-woven fabric 5 is made of a material having a low co-efficient of friction, for example, it may be of a polyamide fiber, so as to act as a layer of lubricant during the contact of envelope 2 with the surface of the cave or container.

The impermeable envelope 2 for fluid containers and for cavities which serve as fluid containers, comprises clamps 4 for connecting the closed envelope 2 to the walls of the cavities or containers.

Figure 2:
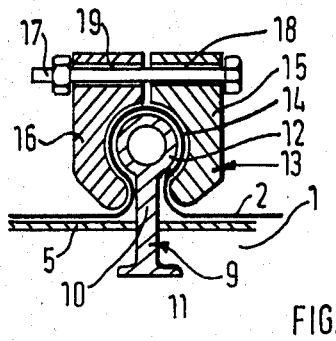
FIG. 2 is a cross-section of an attaching clamp fixed to the cave wall.

In FIG. 2, there is represented one form of the clamps 4. As shown in FIG. 2, clamp 4 comprises a shaped structural element or base member 9 having an upright member 10 having a metallic bar with a cross-member 11 fixed across one end thereof, while, at the other end, member 10 is rigidly connected to a tubular body 12 having its axis perpendicular to the longitudinal axis of the upright bar.

The base member 9 is partially embedded in the wall of cave 1, the cross-member 11 and one part of member 10 are embedded while the remaining part of member 10 and the tubular body 12, project from the surface 3 of the cavity of the cave or container.

Above the tubular body 12 and the part of member 10 that projects from the wall of the cave or container, is fitted a prismatic body 13 having a groove 14 of a form and dimensions designed to lodge the tubular body 12 and the part of the member 10 not in the wall of the cave. The sheet that constitutes the envelope 2 is superimposed over body 12.

The prismatic body 13 is formed of two parts 15 and 16 respectively, that are joined together and which can be locked (in a removable manner) by means of bolts 17 that pass through holes 18 and 19 which are made in the parts 15 and 16, respectively.

Figure 3:
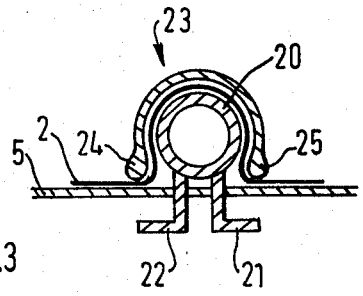
FIG. 3 is a cross-section of an alternative embodiment of a clamp for attaching an envelope to a cave.

In FIG. 3, there is represented an alternative embodiment of a clamp provided by the invention.

As shown in FIG. 3, the clamp comprises a tubular body 20 of a rigid material, for example: a metallic material that holds connected to itself (along two generatrices), two L-shaped base members 21 and 22, that are embedded in the wall of the cave or container in such a way as to bring the wall of the cave into contact with the tubular body 20.

Above the tubular body 20 on which the sheet constituting the envelope 2 is in contact, there can be fitted a member 23, that, in cross-section, has a substantially horse-shoe shape and which is formed out of a deformable elastomeric material having its extremities 24 and 25, enlarged and rounded off.

Figure 4:
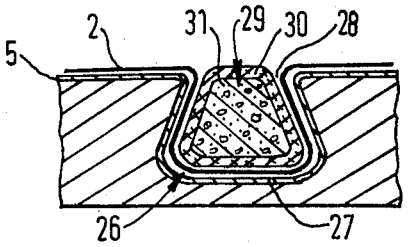
FIG. 4 shows another alternative embodiment of a clamp for attaching the envelope to the cave wall.

In FIG. 4, there is represented a further alternative embodiment of the clamp, according to this invention, that is particularly well suited for being utilized when the fluid to be housed in the container or cave is highly corrosive.

As shown in FIG. 4, the clamp comprises a groove 26, that is made in the wall of the cave or container, and which has a C-shaped negative cross-section, i.e. with its base 27 being larger in width than the groove opening 28, in correspondence of the surface of the cave or container.

The sheet forming the envelope 2, is in contact with the walls of the groove 26, and into this there is inserted a structural element 29 made from an envelope 30 of an inextensible and flexible material, such as, for example, a rubberized fabric filled with concrete 31.

In an alternative embodiment (not shown) of that illustrated in FIG. 4, in place of the concrete 31 there is placed inside the flexible and inextensible envelope 30, a plurality of small plates, each one having a rectangular form and each one provided with an actuating lever that protrudes from the envelope 30.

More particularly, one of the dimensions of the rectangular form, is equal to the dimensions of the opening 28; while its other dimension is equal to the dimension of the bottom 27.

With these plates, it is possible to carry out the 'locking and the releasing' of the envelope 30 in the groove 26 by rotating each plate through the actuating lever.

More particularly, for carrying out this locking, it suffices to rotate each plate by means of the lever, in such a way as to place the plate in a position such as to present the dimension that is equal to that of the bottom 27, transversely of the groove 26. While releasing the lock, it is sufficient to rotate (by means of the lever) each of the plates in such a way as to place each plate in a position which presents the dimension that is equal to that of bottom 27 in a direction that is parallel to the layout of the opening 28.

In FIG. 5, there is shown another alternative embodiment of the clamp according to the present invention.

As shown in FIG. 5, the clamp comprises a structural element 32 having a C-shaped cross-section, the wings 33 and 34 forming acute angles 36 with the base 35.

The structural element 32 is preferably made out of an elastomeric material and it incorporates at least in correspondence of the base 35 a metallic blade 37, and a plurality of studs 38 with their stems protruding from the profile 32, these destined for being embedded in the wall of the cave or container.

In particular, the metallic blade 37, can also extend, either partially or totally, into the wings 33 and 34, where their elasticity, through the existence of blade 37 is varied.

Above the structural element 32 and inside the cavity 39 defined by the wings 33 and 34 and by the base 35, there is disposed the sheet which constitutes the envelope 2 and moreover, inside the cavity 39, there is inserted a structural shape 40 comprised by a rigid tubular body (for example: metallic) or by an element similar to element 29 in FIG. 4, and being comprised by a casing of flexible material (for example, a rubberized fabric) filled with cement.

In FIG. 6, there is shown a further alternative embodiment of a clamp according to this invention.

As shown in FIG. 6, the clamp comprises a pair of members 41 made of a rigid material, for example, a metal with a circular cross section; to each of which is fixed (in correspondence of the core), an appendix with a T-shaped profile 42, embedded in the walls of the cave or container.

Associated to each pair of the adjacent members 41, there is present a spacer member 43 formed by a bar 44 on the ends of which there is also fitted (in a removable manner) pieces of the C-shaped members 45.

The sheet forming the envelope 2, is disposed over the reliefs in such a way as to cover the external surface of the members 45, whereas the spacers 43 by means of the pieces of C-shaped members 45, press the envelope 2 against the facing surface of the two adjacent members 41.

Moreover, each spacer 43 is provided with conventional means (not shown) for varying the length, for rendering removable, the connection of the encasing 2 with the members 41.

The installation of the fluid impermeable covering or envelope 2 on the walls of a cavity to avoid passage of a fluid into or out of the cavity is achieved as follows.

On the internal walls of the container or cave there is fixed or made as in the embodiment of FIG. 4, that part of the clamp which is to be anchored in the wall of the container or tunnel; the position in which the member will be anchored, depends upon the shape of the cavity inside the container or cave. In particular, the anchoring position for this part of the clamp intended to be fixed to the container wall, corresponds, at least with the line lying on the horizontal line circumscribing the maximum width of the container.

Moreover, the surface of the cave or container, is preferably covered with a sheet of non woven fabric 5.

When this operation is terminated, there is then introduced (into the cavity of the container or cave the envelope 2, formed out of the sheet of impermeable, flexible and inextensible material (plastic sheet), the characteristics of this being illustrated in FIG. 7, as previously described. When the envelope 2 is being inserted into the container or cave the envelope is in its collapsed state.

At this point, pressurized air is introduced into the envelope 2, for expanding it (this operation can be aided by manual help) until the external surface of envelope 2 is in contact with the walls of the reservoir, cave or cavity.

During this operation of expanding the envelope 2, the external surface of the envelope slides against the cave walls. This sliding action is made easier by the presence of the non woven fabric layer 5 which acts as a lubricant during this expansion operation.

Once the encasing or envelope 2, has been expanded, all the remaining parts of the clamps are mounted in such a manner as to attach the sheet that forms the envelope 2, to the members which were previous fixed to the cave walls.

Once this operation has also been completed, the pressurized air is extracted and the thus-impermeabilized container or cave is now ready for receiving the fluid for being stored. Moreover, while storing or extracting a fluid from the container and generally, during the functioning of the container, the envelope 2 moves outwardly (i.e. when the fluid is extracted) and inwardly (when the fluid is being introduced for storage) with respect to the surface 3, and such movements are facilitated by the presence of the layer 5 that acts as a lubricant.

From the previous description given of an impermeabilizing covering for fluid containers, it can easily be understood how, with the covering, the objects of the invention can be achieved.

In fact, employment of the special clamps provided by this invention, for connecting the envelope 2 to the walls of the cave or cavity of a container, makes it possible to use an extremely simple construction having a maximum fluid-storage capacity in the cavity or container, this being because the entire space of the cavity can be utilized for containing the fluid.

Moreover, the special clamps used according to this invention, guarantee maintainance to the utmost degree of non-contamination of the stored fluid, since those clamp parts that come into contact with the fluid are made out of the same material as that used for covering the envelope 2.

Furthermore, the use of clamps provided by the invention in association with the particular structure of the impermeable, flexible and inextensible plastic sheet that forms the envelope 2 guarantees a maximum service-life for the impermeabilizing covering because the stresses in the covering are reduced to a minimum.

In fact, the presence of the layer 5 that is fixed to the cave walls, in acting as a lubricant during the sliding of envelope 2 over the walls of the container or cave cavity obviates stresses arising in the fabric, as a result of the sliding.

The liner provided by the invention can be used to line the wall of any cavity in the earth in lieu of concrete to form a fluid impervious wall about the cavity such as, for example, to convert open top holes into a tank for water or other liquid such as a water storage tank. It may also be used to line an enclosed cavity such as a cavern or a void space in the earth to form a storage tank for natural gas or the like.

Although some particular embodiments of the invention have been illustrated and described herein, it is to be understood that the invention includes within its ambit, all other alternative embodiments, derived from the inventive principle, known to a technician of this field.

What is claimed is:

1. A flexible, inextensible, fluid impervious lining member sealing a cavity in the earth against flow of fluid relative to the cavity and the surrounding earth which comprises an enclosed hollow plastic member having a flexible, fluid impervious, inextensible wall and means attaching the said wall to the said surrounding earth comprising spaced rigid elongated cylindrical members which extend along the wall of the cavity, anchor members for anchoring the cylindrical members to the wall of the cavity comprising a series of rigid support members fixed to the cylindrical member and having a base embedded in said surrounding earth, and a jaw member arcuate in cross-section radially movable relative to the said elongated cylindrical member for securing said wall against said elongated cylindrical member to prevent relative movement of the said wall relative to the surrounding earth.

2. The lining member of claim 1 wherein the anchor member comprises rigid tubes and the support members have facing rigid mating members which are substantially C-shaped in cross-section and are disposed to form jaws with the tubes, and means for moving and securing said C-shaped members together about said tube to fix the tube against movement away from the earth.

3. The lining member of claim 1 comprising a rubberized fabric disposed between said flexible and inextensible wall and the said surrounding earth.

4. The lining member of claim 1 wherein the elongated cylindrical members are metal tubes, the anchor members comprise studs disposed along the length of each tube with one edge fixed to the tube, and a base member fixed to and across the opposite edge to form a T-shaped end for the base member.

5. The lining member of claim 4 wherein a rubberized non-woven fabric having a low coefficient of friction is disposed between the said flexible wall and earth for lubricating face on face movement of said flexible wall over the earth surrounding the cavity.

6. The lining member of claim 1 wherein said flexible and inextensible wall is a laminated sheath comprising a rubberized fabric sandwiched between two layers of an elastomeric composition.

7. A fluid impermeable lining for walls of an underground container comprising a closed envelope formed by a single flexible and inextensible fluid impermeable sheet and clamps, characterized in that the clamps are anchored in the walls of the container and comprise at least one tract of profiled members having one extremity firmly fixed to the container wall and a second extremity located between the container wall and the closed envelope and at least one jaw lodged inside the closed envelope adapted for locking, in a removable manner, with the second extremity of the profiled members for enclosing, in between the profiled members and said jaw, one part of the sheet of impermeable, flexible and in extensible material which forms the closed envelope, whereby the continuity of the closed envelope is maintained when the jaw is clamped over the base member.

8. The lining of claim 7, characterized by the fact that the sheet of impermeable, flexible and inextensible material forming the closed envelope, is a rubberized fabric.

* * * * *